United States Patent [19]

Hillberg

[11] Patent Number: 4,607,724

[45] Date of Patent: Aug. 26, 1986

[54] SAFETY APPARATUS FOR ROOFERS

[76] Inventor: Julian T. Hillberg, P.O. Box 1643, Weaverville, Calif. 96093

[21] Appl. No.: 785,677

[22] Filed: Oct. 9, 1985

[51] Int. Cl.[4] ..... A62B 35/00

[52] U.S. Cl. ..... 182/3; 182/36

[58] Field of Search ..... 182/3–9, 182/36, 142

[56] References Cited

U.S. PATENT DOCUMENTS

| | | | |
|---|---|---|---|
| 2,303,954 | 12/1942 | Roke | 182/3 |
| 3,137,487 | 6/1964 | Lesser | 182/3 |
| 3,217,833 | 11/1965 | Smith | 182/3 |
| 3,237,717 | 3/1966 | Jackson | 182/3 |
| 4,052,028 | 10/1977 | Cordero | 182/3 |
| 4,171,032 | 10/1979 | Woolslayer | 182/3 |
| 4,249,713 | 2/1981 | Glynn | 182/3 |
| 4,410,175 | 10/1983 | Shamp | 182/3 |
| 4,425,982 | 1/1984 | Kibbie | 182/3 |
| 4,440,261 | 4/1984 | Clark | 182/3 |

FOREIGN PATENT DOCUMENTS

| | | | |
|---|---|---|---|
| 141893 | 2/1933 | Austria | 182/3 |
| 271254 | 1/1951 | Switzerland | 182/3 |

*Primary Examiner*—Reinaldo P. Machado

*Attorney, Agent, or Firm*—Burns, Doane, Swecker & Mathis

[57] ABSTRACT

A safety device for preventing worker's from falling off of a peaked roof includes a boom pivotally connected to a rotatable stanchion. The rotatable stanchion is supported on the roof by a saddle which is adjustable to permit it to be mounted on various peaked roofs having different slopes. A tether is connected at one end for slidable movement along the boom and is connectable at the other end to the back of a worker's safety belt or harness in order to arrest movement or catch the worker in the event of a slip or fall. The rotatable stanchion and slidable tether give the worker a high degree of mobility on the roof and without interference with work or materials on the roof. A brake operable by tension in the tether arrests rapid sliding of the tether along the boom and a pair of shock absorber devices are provided to assist the brake in reducing any jolt if a falling worker is caught by the safety device.

22 Claims, 13 Drawing Figures

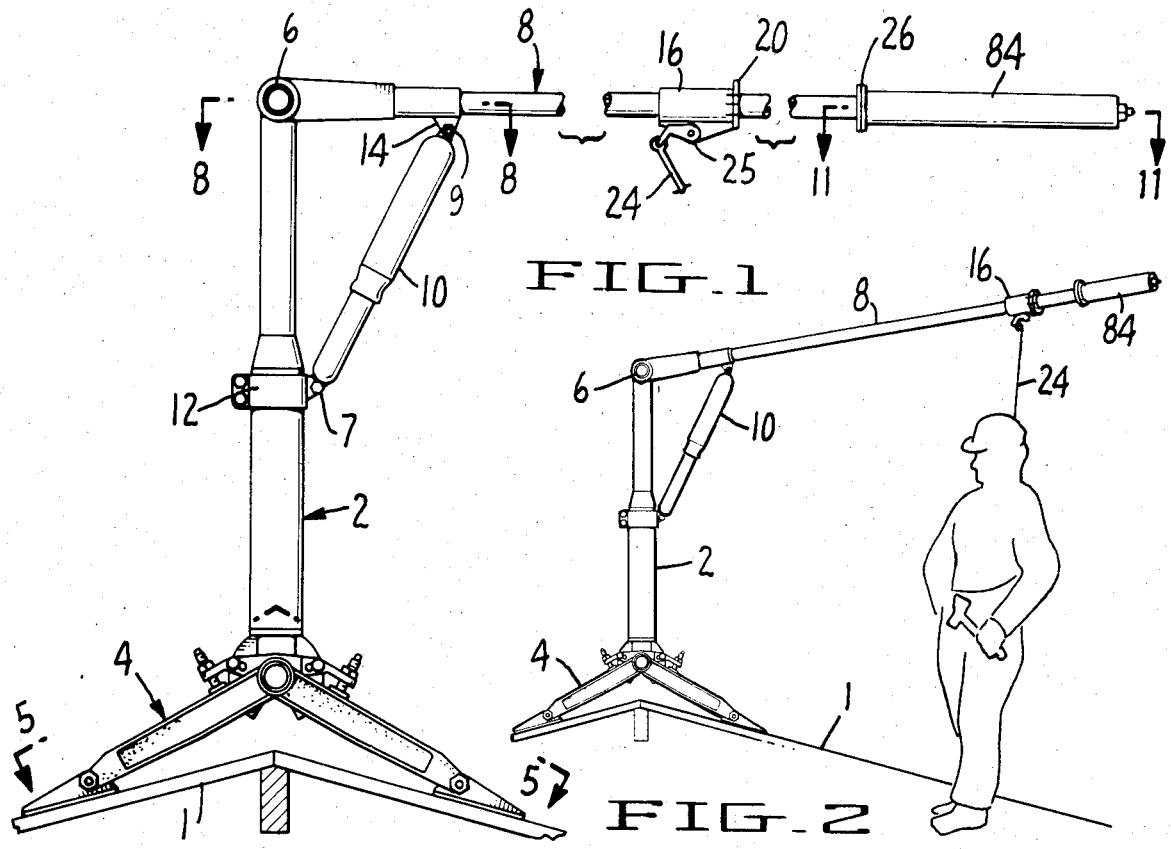
FIG. 1
FIG. 2
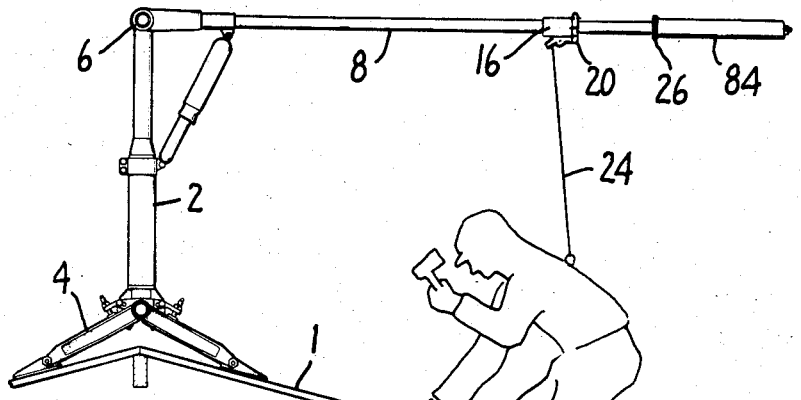
FIG. 3
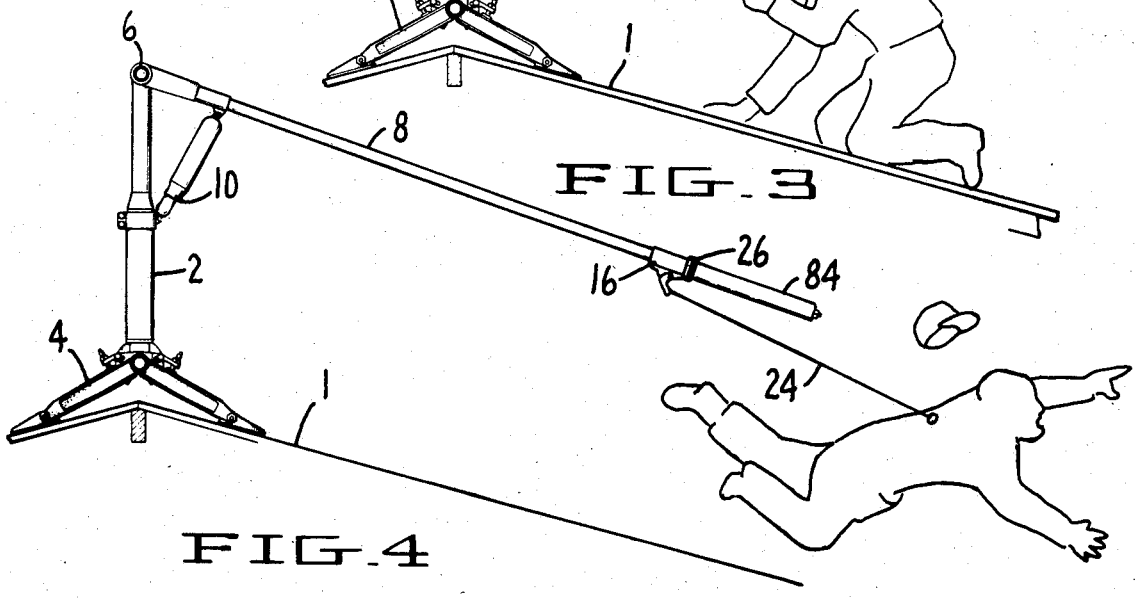
FIG. 4

6
8
80
64
62

8
16
18
20
10
29
25
8
28
26
84

20
8
29
13

10
71
74
76
70
73
84

72
86
78
80
82
26
28
8

SAFETY APPARATUS FOR ROOFERS

BACKGROUND OF THE INVENTION

The present invention relates to a safety device for preventing roofers or other workers from falling off of a roof.

In the past, different techniques of preventing injury to a roofer in the event of a fall have been developed. These techniques have varied from a net or a cushioned pad on which the roofer would land to various tether devices adapted to catch the worker.

Cushioned pads have the disadvantage that they do not help prevent the fall, rather, they simply reduce the likelihood of an inury. Injuries are still possible, however, if the roofer is in an awkward position with he hits the pad. Also, an effective pad system would require pads to be placed at every location that a roofer could possibly fall, thus requiring a large number of pads and a rather lengthy process of putting the pads in place. Transportation of the pads would be difficult due to their necessary bulk. Also, a pad system would do nothing to prevent sudden uncontrolled movements by an off-balance worker that could also lead to an injury. Net systems would basically have the same inherent difficulties.

A safety device for use by workmen on steel structures is disclosed in U.S. Pat. No. 3,217,833. This device essentially consists of a pair of adjustable jaw members which are designed to slidably grip the flange of a steel I-beam. An elongated bar is attached at one end to the jaw members and, at the other end, is connectable to a safety belt worn by the workman. This structure only allows movement by the worker along the particular beam to which the jaw members are attached, and would not be adaptable for use on a roof.

U.S. Pat. No. 3,237,717 discloses an apparatus that is mounted on a roof to provide anchoring points for a roofer. A plurality of brackets are provided on the roof and are inter-connected by rigid connecting rods. A flexible strap element is connected to the rigid rods in order to anchor a worker. The major shortcoming with this system is that it requires substantial rigging which would not be easily installed. Additionally, the extensive network of brackets and connecting rods obstruct the worker's movements and access to certain portions of the roof.

A simple tether device which is adapted to be fastened to a peaked roof is disclosed in U.S. Pat. No. 4,249,713. A strip of metal is bent to provide a connector having a central portion and two extending leg portions. The extending leg portions are provided with openings through which a nail can be driven to attach the connector to the peak of the roof. A safety line is clipped to an aperture in the central portion of the connector. In order to allow the worker sufficient mobility on the roof, the safety line must be relatively lengthy, thereby increasing the distance a roofer would fall before he is caught, particularly when he is working near the connector. Also, since the safety line is at the roof level, it provides somewhat of a hazard in that a worker could easily trip over it. Further, it is an added obstruction to movement and subject to entanglement with roofing materials or tools on the roof surface.

Another tether device is disclosed in U.S. Pat. No. 4,171,032. A bent pole is rotatably supported by a vertical sleeve secured to a side of a structure on which a man is working. A safety line is suspended from the upper end of the pole. Though the rotatable pole allows an increase in the mobility of the worker, the safety line still must be sufficiently long to permit the worker to work near the sleeve. This lengthy safety line has the same disadvantage discussed above. Several difficulties arise in attempting to use this device on a sloped roof. If the roof an overhang, there would be no way to attach the vertical sleeve to the side of the structure in a position that would receive the pole. Also, the fixed angle of the bent pole would lead to problems due to the slope of the roof.

While to social and human advantages of an adequate safety system for roofers are apparent, financial considerations also indicate a long felt need for an arrangement which does not slow or impede a worker in carrying out his normal work when in use, but also provide financial reward for using such a safety arrangement. In particular, one of the significant costs of installing or replacing roofs is insurance of workers. The cost per worker is on the order of $50–$20 per day. Accordingly, a suitable safety device that roof workers will actually use is of great economic and social importance to the workers, employers and building owners.

OBJECTS AND BRIEF SUMMARY OF THE INVENTION

It is a primary object of the invention to provide a roofer's safety device adapted to prevent a worker from uncontrolled slipping or falling off of a sloped roof of any pitch without impeding the worker's mobility or productivity.

In accordance with the invention the roofer's safety device includes a mounting saddle adapted to support a vertical stanchion mounted for aximuthal rotation relative to the saddle for supporting a boom pivotally connected to its upper end for elevational movement. Desirably the boom is resiliently biased, as by damping means, to maintain the boom vertically above the worker and in the case of a slip or fall to assist in arresting rapid movement of a worker over the roof. Tether means are slidably connected at one end with the boom and at the other end to the back of a worker's safety harness or belt. The rotatable stanchion, pivotal boom and slidable tether give the worker a high degree of mobility without the need of a lengthy tether that may interfere with his movement over the roof or with contruction materials or tools on the roof. Means responsive to rapid movement of the tether relative to the boom arrests the tether and the attached worker to slow or absorb the jolt in the event of a fall.

In a preferred form the tether engages the boom through a slidable sleeve which forms a brake surface engagable with the boom by a pivotal lever member actuated by a change in tension of the tether such as by sudden acceleration of the worker in a slip or fall.

In a further preferred form the movement responsive means includes a collar resiliently biased inward from the outer end of the boom so that any impact or shock of the slidable sleeve against the end of the boom is absorbed. The saddle desirably includes adjustable legs to accomodate various slopes or pitches of peaked roofs.

BRIEF DESCRIPTION OF THE DRAWINGS

A preferred embodiment of the invention will be described with reference to the accompanying drawings wherein like reference numerals refer to like parts, and wherein:

FIG. 1 is a general elevation view of the safety device of the present invention;

FIG. 2 is a view similar to FIG. 1 illustrating the invention in use with the tether attached to a worker moving from one location to another;

FIG. 3 is another view similar to FIGS. 1 and 2 of the safety device in use with the tether above and at the back of a worker so as not to interfere with working on a portion of the roof;

FIG. 4 is a view similar to FIGS. 1, 2 and 3 of the safety device illustrating the tether and the workers motion being arrested by the device to catch the worker after a fall;

DESCRIPTION OF THE PREFERRED EMBODIMENT

Figure 5:
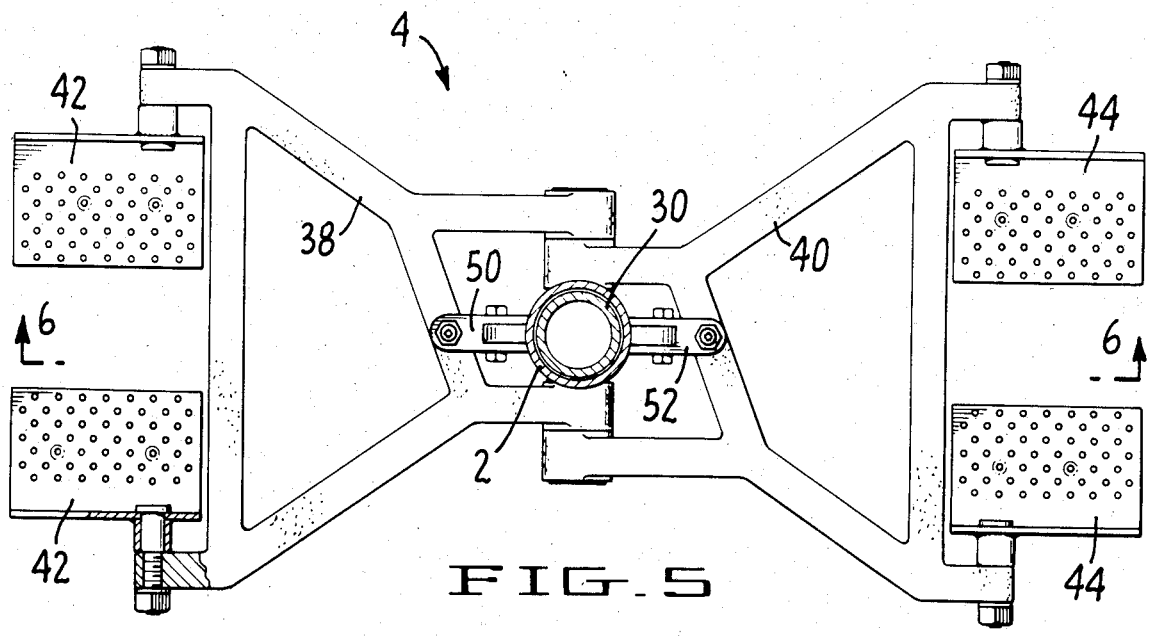
FIG. 5 is a partial cross-sectional plan view taken in the direction of arrows 5—5 in FIG. 1; and showing the mounting saddle structure of the present invention.

Referring to FIG. 1, a preferred embodiment of the present invention includes a vertical stanchion 2 which is rotatably mounted for azimuthal rotation in an adjustable saddle 4. The top portion of the vertical stanchion 2 is pivotally connected at pivot 6 to a boom 8 for elevation movement of the boom relative to pivot 6. A pneumatic cylinder 10 is pivotally connected between an upper portion of stanchion 2 and the inner end of boom 8 in order to limit resiliently the pivotal movement of the boom 8 relative to stanchion 2. As shown, pneumatic cylinder 10 is conveniently connected at one end by a pivot pin 7 to a collar member 12 which is clamped to stanchion 2. The other end of the pneumatic cylinder 10 is pivotally connected by pin 9 to boom 8 by flange member 14.

Figure 12:
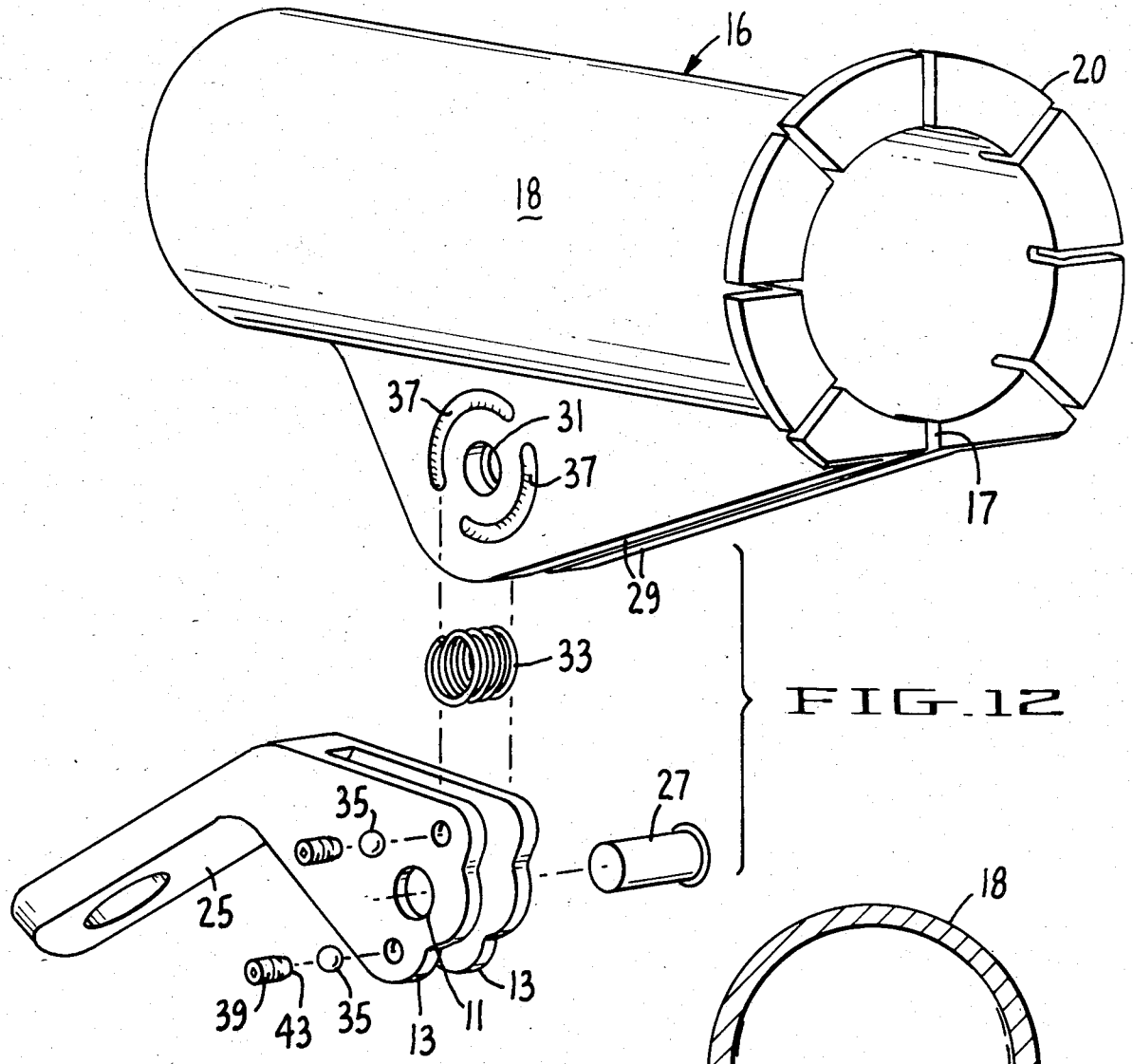
FIG. 12 is an exploded perspective view of a preferred form of the sleeve and lever connection between the tether and boom, including the construction elements of a brake formed by the sleeve and boom.
Figure 13:
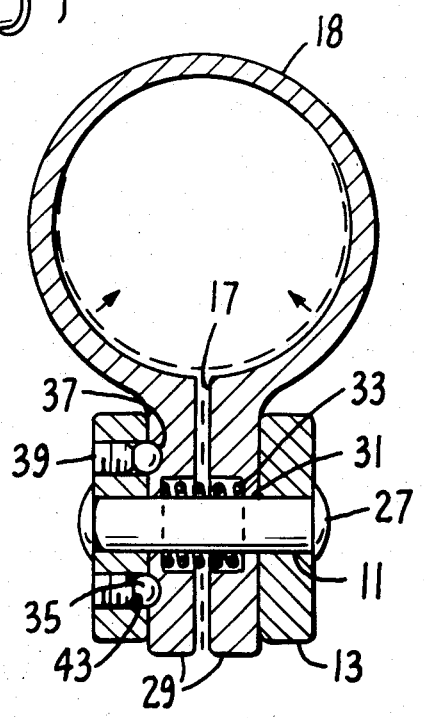
FIG. 13 is a cross-sectional view through the assembled sleeve and brake arrangement of FIG. 12.

A sleeve 16 is slidably mounted on boom arm 8 to form a sliding connection to flexible tether 24. In a preferred form sleeve 16, as best seen in FIG. 12, includes a split tubular wall portion 18 and a split flange portion 20. Wall 18 includes a pair of depending sidewalls or brackets 29 on opposite sides of split 17, and together with flange 20 define a brake arrangement in which circular wall 18 may be squeezed around, and at any location along the length of, boom 8. As shown, a flexible tether may be connected to sleeve 16 through operating lever 25 and pivot pin 27 which passes through bores 11 in bifurcated arms 13 of lever 25 and bores 31 in opposed brackets 29. Arms 13 straddle brackets 29. Brackets 29 are then held apart to maintain a minimum width of split 17 by coil spring 33 surrounding pin 27. In normal operation the friction surface of sleeve 18 is free to slide along boom 8. This permits easy movement of a worker over the roof surface without substantial restraint by the attached tether and boom. However, the diameter of sleeve 18, as indicated in FIG. 13, can be reduced by pressing brackets 29 together to decrease the width of split 17. Lever 25 acts to engage frictionally the inner circumference of sleeve 18 with the surface of boom 8 by rotating balls 35 in serrated tracks or grooves 37 formed in an outer sidewall of one of brackets 29. As indicated in FIG. 13, each serration is about $\frac{1}{4}$ to $\frac{1}{2}$ the diameter of ball 35 so that upon rotation over a ridge in tracks 37, the balls clamp brackets 29 closer together. Balls 35 are held in tracks 37 by the cupped ends 43 of tension set screws 39 threaded into holes 41 in one of arms 13. If desired, the depth of each adjacent serration in tracks or grooves 37 may gradually decrease so that greater rotation of lever 25 progressively pushes brackets 29 inwardly to increase friction between sleeve 18 and boom 8. As indicated, sleeve 16 is preferably formed from a tough plastic such as nylon or polypropylene.

Figures 8, 9, 10, 11:
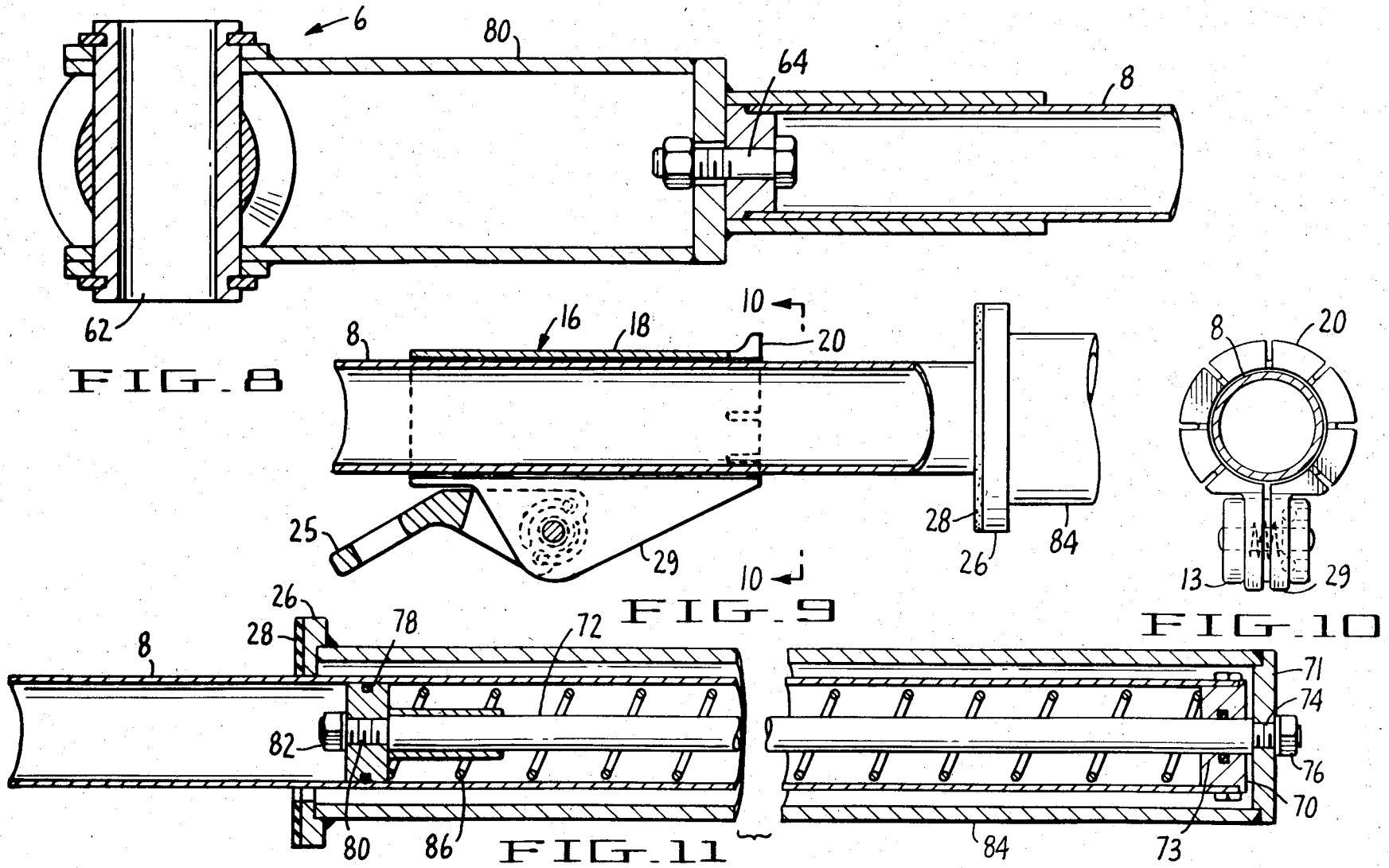
FIG. 8 is a cross-sectional view taken in the direction of arrows 8—8 in FIG. 1 and illustrates the pivotal connection between the rotatable stanchion and the elevation pivotable boom.
FIG. 9 is a cross-sectional view illustrating the slidable connection of the sleeve and tether connecting lever with the boom.
FIG. 10 is an end view of the slidable sleeve and lever operating arrangement taken through the boom in the direction of arrows 10—10 in FIG. 9.
FIG. 11 is a cross-sectional view taken along the plane denoted by arrows 10—10 of FIG. 1 and illustrating additional damping means for arresting the movement of the sleeve on the boom to absorb the jolt when the tether means catches a falling worker.

The end of boom arm 8 is also arranged to absorb the shock of sudden movement or impact on sleeve 18 along its length. For this purpose, as best seen in FIG. 11, the end of boom 8, remote from the stanchion 2, includes a collar 26 having a shoulder portion 28 adapted to engage the flange 20 of sleeve 16. Collar 26 is preferably resiliently biased by spring 45 toward the pivoted end of the boom 8 so that spring 45 reduces and absorbs the jolt if shoulder portion 20 of the sleeve 16 engages the shoulder portion 28 of the collar 26, as indicated in FIG. 4.

Turning now to FIG. 2, the device is shown in use with a worker moving from one location to another on the roof 1. When the worker is in an upright position, desirably pneumatic cylinder 10 is resiliently biased to cause the boom 8 to pivot upwardly in elevation. By pivoting upwardly, the boom 8 provides sufficient clearance above the worker's head to permit easy movement over the roof surface. Any slack in the tether 24 is taken up by such upward movement. Thus, the boom 8 and tether 24 do not interfere with the movement of materials or tools, as well as the worker.

As the worker moves circumferentially about the vertical axis of the stanchion 2, the stanchion rotates in azimuth relative to the saddle 4. Movements in the radial direction relative to stanchion 2 are permitted by slidable sleeve 16 connecting tether 24 with boom 8. Due to the ability of the worker to move freely both circumferentially and radially, the available work area without further adjustment of the safety apparatus of this invention is greatly enlarged. Since there need be no slack in tether 24, the likelihood that the tether 24 will snag on tools or material, or interfere with the worker's movements is eliminated. Rotatable stanchion 2, pivotal boom 8 and slidable sleeve 16 accordingly work together to give the worker a wide range of motion without the necessity of a lengthy tether 24, which would further increase the worker's risk of tripping or getting tangled in the tether.

FIG. 3 shows the safety device of the present invention with the worker working on a portion of the roof. As the worker assumes a working position, the boom 8 pivots downwardly. The length of the pneumatic cylinder 10 shortens to accomodate the pivoting of the boom 8, however the pneumatic cylinder 10 adjustably biases boom 8 upwardly to maintain a desirably tautness in tether 24.

As shown in FIG. 4, the safety device is arranged to halt sudden movement or to catch the worker in the event of a slip or fall without providing an extreme jolt to the worker. When the worker begins to accelerate, as by such a slip or fall, the tether pulls against lever 25 to actuate braking action beween sleeve 16 and boom 8. Such movement at the same time pulls boom 8 downwardly. Free movement of the boom 8 is prevented due to the damping function provided on the boom 8 by the pneumatic cylinder 10. This damped movement may be adjusted so that it is sufficient to allow the worker to regain his balance if the worker is not completely out of control.

If the worker is completely off balance, as illustrated in FIG. 24, the braking means is actuated by a sudden rotation of lever 25 to move balls 35 out of their respective serrations in track 37 against the force of spring 33 and thereby close split sleeve 18 around boom 8. Additionally, sleeve 16 may slide outwardly from stanchion 2 until shoulder 20 of the sleeve 16 engages shoulder 28 of spring-biased collar 26 to reduce further the jolt of the worker's body on line 24. A further reduction in the jolt is produced by pneumatic cylinder 10, which damps pivoting of boom 8 if shoulders 20 and 26 engage. Because a sudden jolt alone can injure a worker, the present invention not only catches a falling worker, but also promptly decellerates his movement to reduce the likelihood of such an injury far sooner by catching a working before he falls off a roof.

Figure 6:
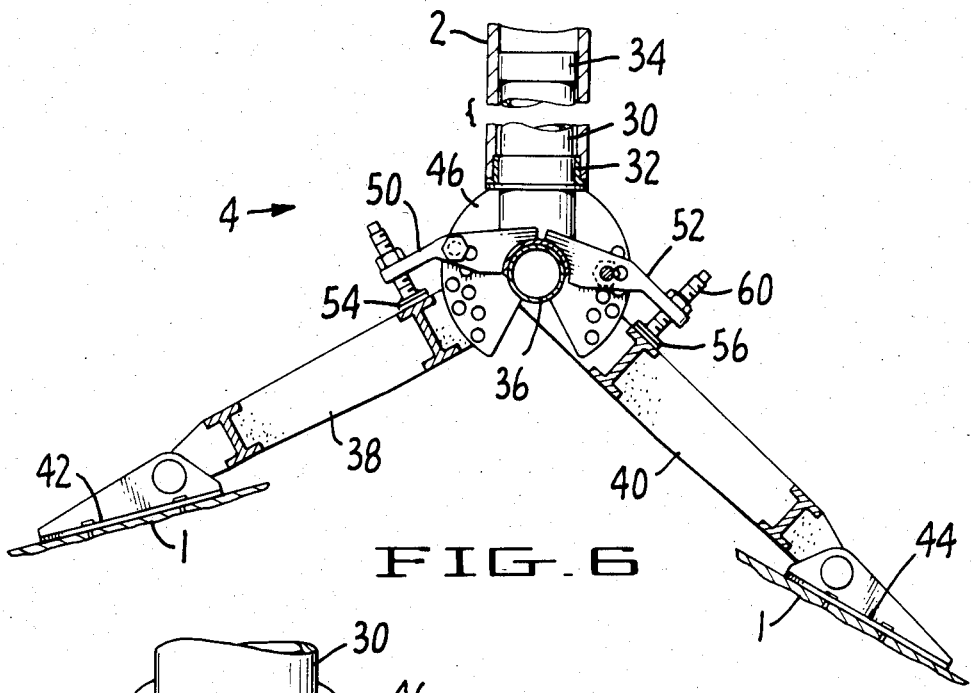
FIG. 6 is a cross-sectional elevation view taken in the direction of arrows 6—6 in FIG. 5.

Referring now to FIGS. 5 and 6, the saddle 4 preferably includes a vertical post 30 over which hollow stanchion 2 fits. Bearing surfaces 32 and 34 allow the hollow stanchion 2 to rotate freely in azimuth about the vertical post 30. Desirably, the vertical post 30 is supported on a horizontal shaft 36 on which support legs 38 and 40 are pivotally mounted. Support legs 38 and 40 each include a pair of pivotal anchor plates 42 and 44, respectively, which permit the support legs to be anchored independently and securely to roof 1 by bolts, nails or the like. As shown in the drawings, the anchor plates 42 and 44 include a plurality of holes through which nails may be driven. The large number of holes allow the nails or screws to be driven into a selected portion of the roof, for example, into a roof joint or rafters.

Figure 7:
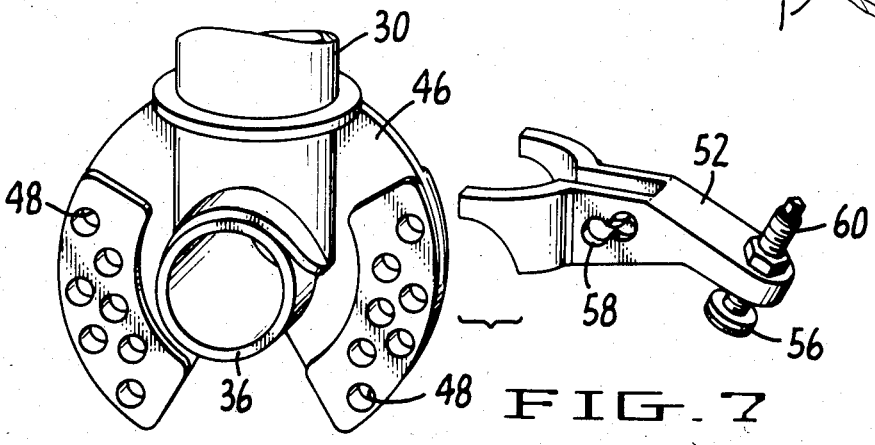
FIG. 7 is an exploded elevation view showing means for adjusting the legs of the saddle structure to accommodate the saddle to different roof pitches.

The position of the support legs can be adjusted by an adjustment means shown best in FIGS. 6 and 7. A disk 46 is concentric with the horizontal shaft 36, and includes a plurality of apertures 48 arranged in inner and outer rows. Adjustment arms 50 and 52 include abutment members 54 and 56, respectively, which are adapted to engage pivotal support legs 38 and 40, respectively. The adjustment arms 50 and 52 each include a roughly hourglass-shaped aperture 58 to align with either the outer or inner row of holes 48 in disc 46.

Coarse adjustment of the angular position of a support leg is made by rotating the corresponding adjustment arm to a desired position. The aperture 58 is then aligned with a hole 48 in disk 46, and a pin or a bolt inserted through the aligned apertures to lock the adjustment arm into position. Fine adjustments of the support legs is gained by rotating the threaded shaft 60 which varies the relative distance between the adjustment arm 52 and the abutment member 56.

In use, the weight of the safety device causes the support legs 38 and 40 to pivot upwardly until they contact the abutment members 54 and 56, respectively. Thus, by properly setting the position of the angular arms 50 and 52 and the abutment members 54 and 56, the support legs can be adjusted to accomodate various roofs of different slopes.

FIG. 8 illustrates the pivotal connection 6 between stanchion 2 and boom 8. The top of stanchion 2 is provided with a pivot pin 62 about which the base 80 of boom 8 is free to pivot. As shown, the boom 8 is fitted into a socket portion of the base 80 and is fastened in place by a nut and bolt assembly 64.

FIGS. 9 and 10 show the arrangement of slidable sleeve 16 on boom 8. Desirably slidable sleeve 16 may be formed of plastic or include a plastic inner surface to engage the outer surface of boom 8 formed of steel or aluminum.

Referring now to FIG. 11, movement of sleeve 16 on boom 8 is arrested by collar 26, slidably biased inwardly from distal end guide 70 closing the end of boom 8. Collar 26 is on the inner end of telescopic sleeve 84 and slidably supported by shoulder 28 on the outside of boom 8 and on a plunger 72 inside boom 8. Plunger 72 includes at one end a threaded portion 74 which extends through bore hole 74 in end portion 71 of sleeve 84 and is fastened in place by nut 76. The inner end of plunger 72 is connected to a slidable piston or guide member 78 by a threaded portion 80 and a nut 82. As shown, telescoping end portion 84 covers the outer end of boom 8. Thus, the slidable guide member 78 and the boom end guide 70 maintain plunger 72 and telescoping sleeve 84 in a concentric relationship. A coil spring 86 between guides 70 and 78 normally biases plunger 72, and thereby collar 26, toward the pivoted end of the boom 8. Spring 86 absorbs a large portion of the force if the sleeve and brake means should fail to arrest a worker's uncontrolled slipping or falling. In such a case shoulder 20 of sleeve 16 strikes shoulder 28 of collar 26, thus further reducing the jolt on a falling worker if he is caught at the end of boom 8.

In summation, an improved safety device for use by workers on a roof includes a rotatable stanchion mounted on the roof. A boom having a tether slidable along its length is pivotally connected at the top of the stanchion, whereby the azimuthly rotatable stanchion, elevationally pivotable boom, and slidable tether permit free movement of the worker on the roof without restraint or interference between the boom or tether and the roof's worksurface. Braking means and damping means are provided to restrict sudden pivotal movement of the boom or sliding of tether along boom 8 to halt movement or absorb the shock (or both) when the tether catches a slipping or falling worker.

Various modifications of the preferred embodiment will become readily apparent to one of ordinary skill in the art from the foregoing specification. For example, the pneumatic cylinder 10 could be a hydraulic cylinder, or the biasing spring 86 could easily be replaced by other biasing means. Various brake means responsive to a sudden tug or pull on tether 24 may be used to arrest uncontrolled worker movement on the roof. Alternatively, spring biased collar 26 at the outer end of boom 8 could be replaced with a rubber or sponge-like material designed to absorb the jolt of a falling worker being caught by the safety device. Further, it will be apparent that an acceleration arresting mechanism can be included within the tether, if desired.

The principles, preferred embodiments and modes of operation of the present invention have been described in the foregoing specification. The invention which is intended to be protected herein, however, is not to be construed as being limited to the particular forms disclosed, since these are to be regarded as illustrative rather than restrictive. Variations and changes may be made by those skilled in the art without departing from the spirit of the invention.

What is claimed is:

1. A safety device for preventing workers from falling off of a peaked roof, comprising:

(a) a saddle adapted to be mounted on the peak of said roof;

(b) a stanchion mounted on said saddle, said stanchion having at least a top portion rotatable relative to said stanchion;

(c) a boom pivotally connected to a top portion of said stanchion, said boom being pivotable in the vertical direction with respect to said stanchion;

(d) damping means for resiliently biasing said boom above a worker and for damping vertical pivoting of said boom relative to said stanchion;

(e) tether means slidably connected at one end with said boom and connectable at the other end to a safety belt or harness at a worker's back, said rotatable stanchion and slidable tether allowing the worker a high degree of work mobility on the roof without interference by said tether means; and, (f) means responsive to rapid movement of said tether means relative to said boom in the event of a worker's loss of footing or falling, to arrest said tether means so that said tether means and said boom means absorb the force of such rapid movement when said tether means catches the worker.

2. The safety device of claim 1, wherein said damping means includes a pneumatic cylinder having first and second ends, said first end pivotally connected with said stanchion at a portion intermediate said top portion and said bottom portion, and said second end pivotally connected with said boom at a portion radially spaced from said stanchion.

3. The safety device of claim 2 wherein said pneumatic cylinder includes spring biasing means to urge said boom to a predetermined angle relative to said stanchion.

4. The safety device of claim 1, wherein said tether means includes a sleeve slidably mounted on said boom and a cable connected at one end with said slidable sleeve and connectable at the other end to said worker's safety belt or harness.

5. The safety device of claim 4 wherein said movement responsive means includes a brake surface carried by said sleeve engagable with said boom and a lever member pivotally actuatable by tension along said cable to engage said braking surface with said boom.

6. The safety device of claim 4, wherein said movement responsive means includes a collar arranged around the outer periphery of said boom adjacent an end remote from said stanchion, said collar being biased axially inwardly toward said stanchion and operative to engage said slidable sleeve in the event of a worker's fall, thereby to absorb the shock of said slidable sleeve contacting said collar member thereby to decellerate said tether means and the worker at the end of the full movement allowed to the worker by each of said stanchion, said boom and said tether means.

7. The safety device of claim 1, wherein said stanchion includes a hollow tube and said saddle includes a vertical post adapted to be received in said hollow stanchion and at least two support legs pivotally connected to said vertical post, said support legs adapted to engage said roof on opposite sides of the peak, each of said legs being individually adjustable by adjustment means to accomodate roofs of different slopes.

8. The safety device of claim 7, wherein said adjustment means includes a horizontal shaft about which said support legs are freely rotatable, an apertured disk concentric with said horizontal shaft, and an adjustment arm having an abutment member, said adjustment arm being rotatable about said horizontal shaft and including an aperture which is adapted to align with an aperture in said disk whereby a pin inserted through the aligned apertures locks the adjustment arm in place so that said abutment member is adapted to engage said support legs.

9. The safety device of claim 8, wherein said abutment member is mounted on a threaded shaft threaded through said adjustment arm, whereby fine adjustments of the position of said abutment member are made by turning the threaded shaft.

10. A safety device for preventing a worker from falling off of a roof, comprising:

(a) mounting means adapted to be arranged on said roof;

(b) a vertical stanchion mounted for azimuthal rotation in said mounting means;

(c) a boom pivotally connected to a top portion of said stanchion, said boom being pivotable in elevation with respect to said stanchion;

(d) damping means for restricting elevational pivoting of said boom relative to said stanchion;

(e) brake means slidably engaging a substantial length of said boom; and (f) tether means for connecting a predetermined length of cable or rope from said brake means to a worker's safety harness or belt, said rotatable stanchion, said slidable brake means and said tether means allowing the worker a high degree of mobility over on the surface of the roof, but in the event of a worker's slipping on said roof, said tether means operating to actuate said brake means to catch the worker before an unrestrained fall off the roof.

11. The safety device of claim 10, wherein said first boom damping means includes a pneumatic cylinder having first and second ends, said first end pivotally connected with said stanchion at a portion intermediate the length of said stanchion, and said second end pivotally connected with said boom at a portion axially spaced from said stanchion.

12. The safety device of claim 10, further comprising second damping means adjacent the outer end of said boom, said second damping means functioning in response to engagement of said brake means therewith to absorb further the shock when said brake means and said tether means catches the worker.

13. The safety device of claim 10, wherein said brake means includes a split sleeve slidably mounted on said boom and lever means for closing said split sleeve around said boom, and said tether means includes a cable connected at one end with said lever means and connectable at another end to said safety belt or harness.

14. The safety device of claim 12, wherein said second damping means includes a biased collar arranged around the outer periphery of said boom adjacent an end remote from said stanchion, said collar operative to engage said slidable brake means in the event of a worker's fall, thereby to absorb further the shock when said brake means is actuated by tether means adjacent said remote end of said boom to catch the worker.

15. The safety device of claim 10, wherein said stanchion includes a hollow tube and said mounting means includes a saddle having a vertical post adapted to be received in said hollow stanchion and at least two support legs pivotally connected with said vertical post, said support legs adapted to engage said roof on opposite sides of a peak, and said legs being individually adjustable by adjustment means to accomodate roofs of different pitches or slopes.

16. The safety device of claim 15, wherein said leg adjustment means includes a horizontal shaft about which said support legs are freely rotatable, an apertured disk concentric with said horizontal shaft, and an adjustment arm having an abutment member, said adjustment arm being rotatable about said horizontal shaft and including an aperture which is adapted to align with an aperture in said disc whereby with a pin inserted through the aligned apertures to lock the adjustment arm in place, said abutment member are adapted to engage said support legs.

17. The safety device of claim 16, wherein said abutment member is mounted on a threaded shaft threaded through said adjustment arm, whereby fine adjustments of the position of said abutment member are made by turning the threaded shaft.

18. Apparatus for preventing workers from falling off of a sloped roof, comprising:

(a) a saddle adapted to be mounted on the peak of said roof and including a vertical post and at least two support legs pivotally connected to said post, each of said support legs adapted to extend on opposite sides of said peak and including anchor plates for attaching said legs to said roof;

(b) a hollow tubular stanchion having a bottom portion rotatably mounted for azimuthal rotation about said vertical post of said saddle;

(c) a boom pivotally connected to a top portion of said stanchion, said boom being vertically pivotable with respect to said stanchion;

(d) tether means including a sleeve slidably mounted on said boom and a cable connected at one end for travel with said slidable sleeve along said boom and connectable at another end above and behind a worker's back to a safety belt or harness, said rotatable stanchion and slidable tether allowing the worker a high degree of mobility for work on the roof without interference by tools or materials thereon, said tether means including brake means responsive to sudden tension on said cable to arrest sliding movement of said sleeve along said boom so that in the event of a worker's slipping or falling, said tether means is operative to restrain uncontrolled movement of the worker on or off the roof.

19. The apparatus of claim 18 further comprising damping means including shock absorber having first and second ends, said first end pivotally connected with said stanchion at a portion intermediate said top portion and said bottom portion, and said second end pivotally connected to said boom at a portion spaced from said stanchion.

20. The apparatus of claim 19 further comprising second damping means including a biased collar arranged around the outer periphery of said boom adjacent an end remote from said stanchion, said collar operative to engage said slidable sleeve of said tether means to assist said brake means, thereby to absorb the shock when said tether means responds to such uncontrolled movement of the worker.

21. The apparatus of claim 18, wherein said saddle includes adjustment means for individually adjusting said support legs to accomodate roofs of different slopes, said adjustment means including a horizontal shaft about which said support legs are freely rotatable, an apertured disk concentric with said horizontal shaft, and an adjustment arm having an abutment member, said adjustment arm being rotatable about said horizontal shaft and including an aperture which is adapted to align with an aperture in said disk whereby a pin inserted through the aligned apertures may lock the adjustment arm in place, said abutment member adapted to engage said support legs.

22. The apparatus of claim 21, wherein said abutment member is mounted on a threaded shaft threaded through said adjustment arm, whereby fine adjustments of the position of said abutment member are made by turning said threaded shaft.

* * * * *